US006243917B1

(12) United States Patent
Conrad

(10) Patent No.: US 6,243,917 B1
(45) Date of Patent: Jun. 12, 2001

(54) FLOATING BRUSH FOR A VACUUM CLEANER HEAD

(75) Inventor: Wayne Ernest Conrad, Hampton (CA)

(73) Assignee: Fantom Technologies Inc., Welland (CA)

( * ) Notice: Subject to any disclaimer, the term of this patent is extended or adjusted under 35 U.S.C. 154(b) by 0 days.

(21) Appl. No.: 09/342,913

(22) Filed: Jun. 30, 1999

(51) Int. Cl.[7] ..... A47L 9/04
(52) U.S. Cl. ..... 15/372; 15/389; 15/392
(58) Field of Search ..... 15/372, 389, 392

(56) References Cited

U.S. PATENT DOCUMENTS

| | | | | |
|---|---|---|---|---|
| 1,904,972 | | 4/1933 | Willis | 15/357 |
| 1,953,617 | * | 4/1934 | Kitto | 15/392 |
| 2,020,600 | | 11/1935 | Beckef | 15/401 |
| 2,416,420 | | 2/1947 | Taylor | 15/372 |
| 2,432,086 | * | 12/1947 | Boisselier | 15/368 |
| 2,614,283 | | 10/1952 | Thornwald | 15/359 |
| 2,672,643 | * | 3/1954 | Langille | 15/392 |
| 2,753,585 | * | 7/1956 | Eberhart | 15/392 |
| 3,012,267 | * | 12/1961 | Kemnitz | 15/372 |
| 4,951,347 | * | 8/1990 | Star et al. | 15/340.3 |
| 5,297,312 | * | 3/1994 | Zuiderveen et al. | 15/392 |

FOREIGN PATENT DOCUMENTS

| | | | |
|---|---|---|---|
| 1124463 | 6/1982 | (CA) | 15/67 |
| 1281858 | 3/1991 | (CA) | 15/53.1 |
| 2020984 | 7/1991 | (CA) | 15/53.1 |
| 2169591 | 3/1996 | (CA) . | |

* cited by examiner

*Primary Examiner*—Robert J. Warden, Sr.
*Assistant Examiner*—Theresa T. Snider
(74) *Attorney, Agent, or Firm*—Philip C. Mendes da Costa; Bereskin & Parr

(57) ABSTRACT

A vacuum cleaner head has a casing having a dirty air inlet and a brush mounted above the dirty air inlet and moveable with respect to the dirty air inlet. The brush is pivotally mounted to the casing by a pivot member at a position forward of the brush. The pivot member transmits force generated by the rotation of the brush to the casing thereby reducing the required offsetting upward biasing force and permitting effective floating of brush in the vacuum cleaner head.

22 Claims, 3 Drawing Sheets

FLOATING BRUSH FOR A VACUUM CLEANER HEAD

FIELD OF THE INVENTION

This invention relates to vacuum cleaner heads having a rotatably mounted brush. Such vacuum cleaner heads may be used with upright vacuum cleaners, canister vacuum cleaners, central vacuum cleaners and the like.

BACKGROUND OF THE INVENTION

Typically, vacuum cleaners use a vacuum cleaner head having a dirty air inlet which is in flow communication with a source of suction (e.g. a motor driven fan unit). When the vacuum cleaner is turned on, the suction source creates a low pressure area which draws air into the dirty air inlet. Dirt particles and the like are entrained in the air flow and transported by the air flow to a dirt separation mechanism provided with the vacuum cleaner. In order to assist the entrainment of dirt particles and the like in the air stream entering the dirty air inlet, an agitator (e.g. a rotatably mounted brush) is provided. The rotation of the brush agitates the surface (e.g. carpet) over which the vacuum cleaner head travels. This agitation disturbs the dirt which is in the carpet so that it may more easily be entrained in the air entering the dirty air inlet.

It is know in the art to mount the brush in a fixed position in the vacuum cleaner head. In order to accommodate different surfaces (eg. carpets having different pile heights), it is known to manually adjust the height of the brush with respect to the dirty air inlet. Automatic adjustment controls for adjusting the height of the brush with respect to the dirty air inlet are also know. One example is shown in U.S. Pat. No. 2,614,283 (Thornwald). According to this patent, a pivotally mounted nap engaging structure is provided. The structure is pivoted about a pivot point positioned rearward of the brush.

SUMMARY OF THE INVENTION

The instant invention discloses a pivoting structure for adjustment of the height of the brush with respect to the dirty air inlet. The forces produced due to the rotation of the brush tend to cause the brush to move downwardly. For the brush to float freely, this downward force must be offset by an oppositely directed force (eg. an upwardly directed biasing force). By pivotally mounting an upwardly biased pivot member to the casing of the vacuum cleaner head at a position forward of the brush, at least some of the forces produced due to the rotation of the brush may be transmitted to the casing by the pivot member. Thus, the biasing member may exert a reduced upward force to offset the downward force produced by the rotation of the brush (compared to if the pivot arm were mounted to the rear of the brush). As the force exerted by the biasing member is reduced, the brush may float more freely. Thus the brush may move more easily in the vertical direction in response to the pile of the carpet which it encounters In accordance with the instant invention, there is provided a vacuum cleaner head for cleaning a surface comprising a casing having a lower surface, a front end, a rear end and an air flow path, the air flow path including a dirty air inlet provided in the lower surface, a brush rotatably mounted above the dirty air inlet and movably mounted with respect to the dirty air inlet between a lowered position and a raised position, the brush having a longitudinally extending central axis, a pivot arm having a first end connected to the brush member and a second end pivotally mounted with respect to the casing at a position forward of the central axis; and, a biasing member to bias the brush to the raised position wherein the rotation of the brush produces a force pivoting the brush towards the dirty air inlet.

In accordance with another embodiment of the instant invention, there is provided a vacuum cleaner head for cleaning a surface comprising a casing having a lower surface, a front end, a rear end and an air flow path, the air flow path including a dirty air inlet provided in the lower surface, a brush rotatably mounted above the dirty air inlet and movably mounted with respect to the dirty air inlet between a lowered position and a raised position, the rotation of the brush producing a force pivoting the brush towards the dirty air inlet, the brush having a longitudinally extending central axis, pivot means for pivotally mounting the brush member to the casing at a position forward of the central axis, the pivot means positioned to transmit at least a portion of the force to the casing, and biasing means to bias the brush to the raised position.

In one embodiment, the first end is disposed upwardly with respect to the second end when the brush is in the raised position.

In another embodiment, the pivot arm extends upwardly at an angle to the horizontal, the angle selected for transmitting a portion of the force produced by the rotation of the brush to the casing.

In another embodiment, the force comprises a downward component and the angle is selected for transmitting at least a major portion of the downward component to the casing. The angle may be from 25 to 65°, preferably from 35–55° and more preferably from 40–50°.

In another embodiment, the brush is rotatably mounted about an axle and the axle is rotatably received in the first end.

In another embodiment, a pivot arm is positioned adjacent each lateral side of the brush and the brush is rotatably mounted in the first ends.

In another embodiment, the vacuum cleaner head further comprises a mounting bracket provided adjacent each lateral side of the brush, each mounting bracket having an inner side facing a respective lateral end of the brush for pivotally receiving thereon the second end of the respective pivot arm and an outer side to attach the mounting bracket to the casing, at least one upper stop member provided on an inner side to engage the pivot arm when in the raised position and at least one lower stop member provided on an inner side to engage the pivot arm when in the lowered position. The biasing member may comprise a generally U shaped leaf spring which is positioned between the mounting bracket and the brush. The spring may have a first portion that abuts against the lower stop and a second portion that is drivenly connected to the pivot arm.

DESCRIPTION OF THE DRAWINGS

These and other advantages of the instant invention will be more fully and completely understood in accordance with the following description of the preferred embodiment of the invention in which.

DESCRIPTION OF THE PREFERRED EMBODIMENT

Figure 1:
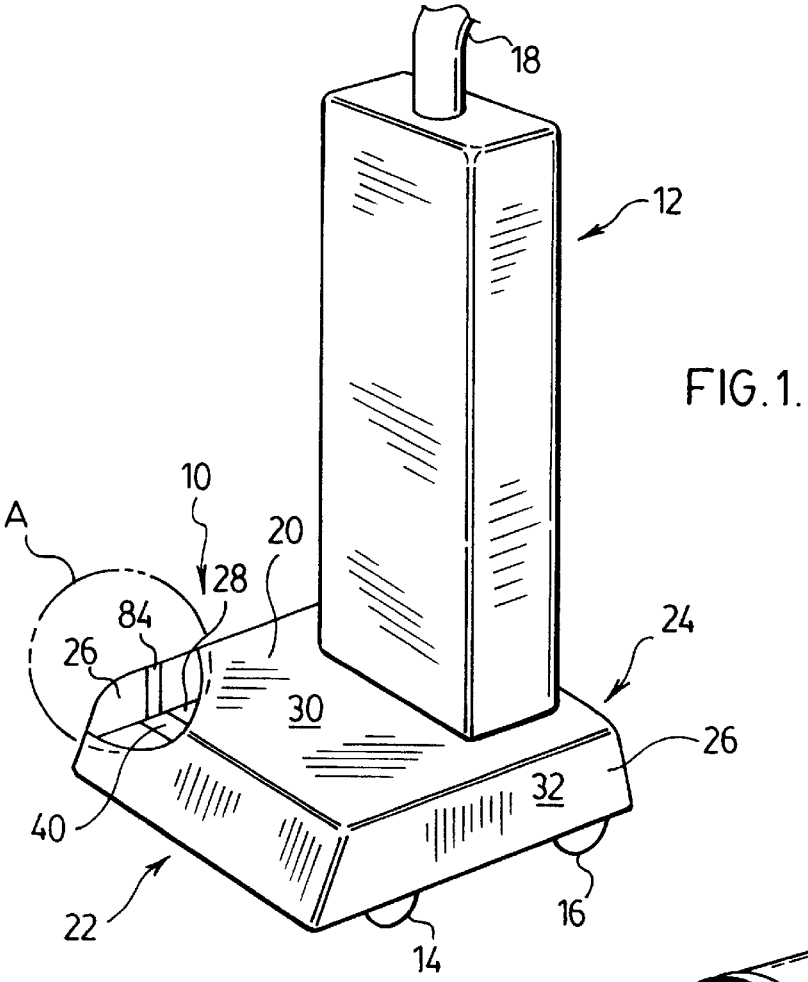
FIG. 1 is a partially cut away, perspective view of an upright vacuum cleaner with the upper casing in the upright storage position.

According to the preferred embodiment of FIG. 1, a vacuum cleaner comprises a vacuum cleaner head 10 and an upper casing 12. Vacuum cleaner head 10 is provided with glide means for permitting vacuum cleaner head 10 to move over a surface being cleaned (eg. front wheels 14 and rear wheels 16). Upper casing 12 is provided with handle 18 and is pivotally mounted with respect to vacuum cleaner head 10 by any means known in the art. In the case of an upright vacuum cleaner, a spring may be used to offset the weight of the handle.

Vacuum cleaner head 10 may be for use with any vacuum cleaning system known in the industry. Accordingly, vacuum cleaner head 10 may be used with an upright vacuum cleaner as shown in FIG. 1. Alternately, for example, it may be used with a central vacuum system or with a canister vacuum system. As such, the motor for providing suction may be positioned in upper casing 12 or as part of the canister body or the central vacuum cleaning body as is known in the art. Further, it will be appreciated that vacuum cleaner head 10 may be dimensioned to include a motor positioned therein.

The vacuum cleaner may use any dirt separation mechanism known in the industry. For example, upper casing 12 may include a filter bag or a cyclone separation mechanism.

In FIG. 1, vacuum cleaner head 10 comprises a casing 20 having a front end 22, a rear end 24, and spaced apart lateral sides 26 which extend longitudinally from front end 22 to rear end 24. Casing has a lower surface 28, an upper surface 30 and side surfaces 32 (defined by lateral sides 26) extending there between. The actual shape of casing 20 may vary for design reasons and need not be of any particular size or shape. The forward portion of vacuum cleaner head 10 is provided with dirty air inlet 40. Dirty air inlet 40 may be of any construction and positioning known in the art. Generally, dirty air inlets for vacuum cleaner heads comprise transversely extending openings provided in lower surface 28.

Cleaner head 10 further includes a dirty air outlet for connecting vacuum cleaner head 10 in air flow communication with the dirt separation mechanism which is positioned downstream hereof. An air flow path extends through vacuum cleaner head 10 between dirty air inlet 40 and the air outlet such that dirty air inlet 40 is in air flow communication with the dirt separation mechanism and the source of suction.

Figure 2:
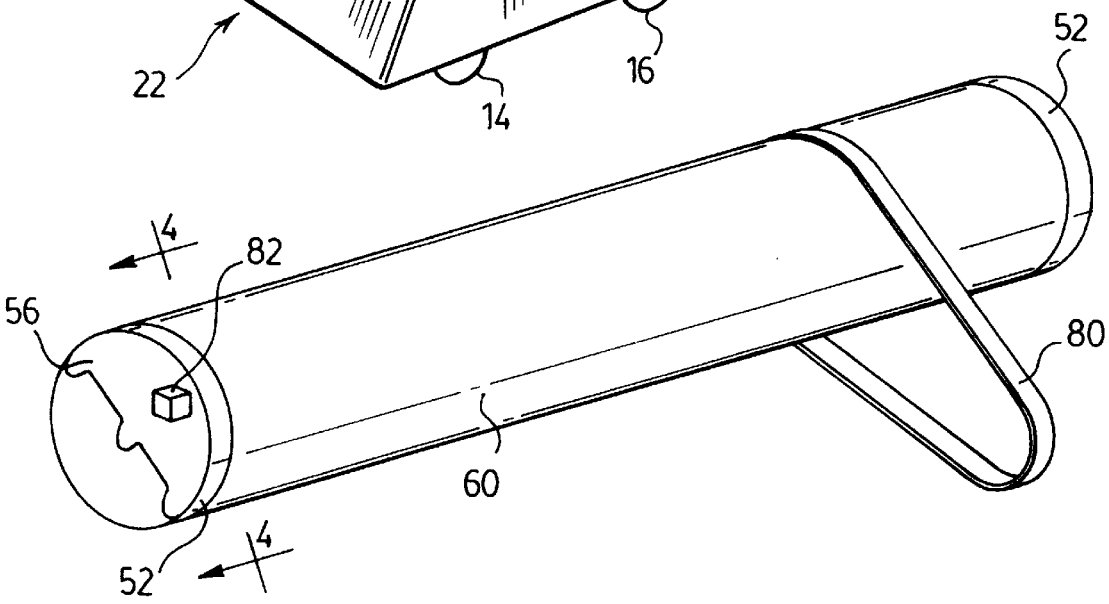
FIG. 2 is a perspective view of a brush which may be used in the vacuum cleaner head shown in FIG. 1.

Vacuum cleaner head 10 is sized to receive a brush 60. Brush 60 may be any agitation means known in the vacuum cleaner art which is rotatably mounted for assisting the cleaning action of a vacuum cleaner head. Preferably, brush 60 comprises a rotatably mounted brush having opposed lateral ends 34 and a plurality of bristles provided thereon so as to agitate, for example, a carpet as brush 60 is rotated. Brush 60 may be rotatably mounted and rotatably driven by any means known in the art. For example, brush 60 may be rotatably driven in casing 20 by any means known in the art. As shown in FIG. 2, brush 60 is driven by a drive belt 80, which may be driven, eg., by a motor or an air powered turbine (i.e. a turbine that is driven by air passing through vacuum cleaner head 10). When brush 60 is rotating and in contact with the surface being cleaned, the vacuum cleaner head is in the floor cleaning mode.

It is also know for a vacuum cleaner to be used to clean floors having a surface which may be scratched by a rotating brush (eg. wood flooring) and for vacuum cleaners to have a nozzle provided on the end of a hose for use in cleaning, for example, furniture, crevices or the like. Vacuum cleaners may be converted to such a canister or bare floor mode by interrupting the rotation of the brush or by raising the brush while the brush is still rotating. Various means are known in the art for so converting a vacuum cleaner head and any such means may be included in vacuum cleaner head 10.

Figure 3:
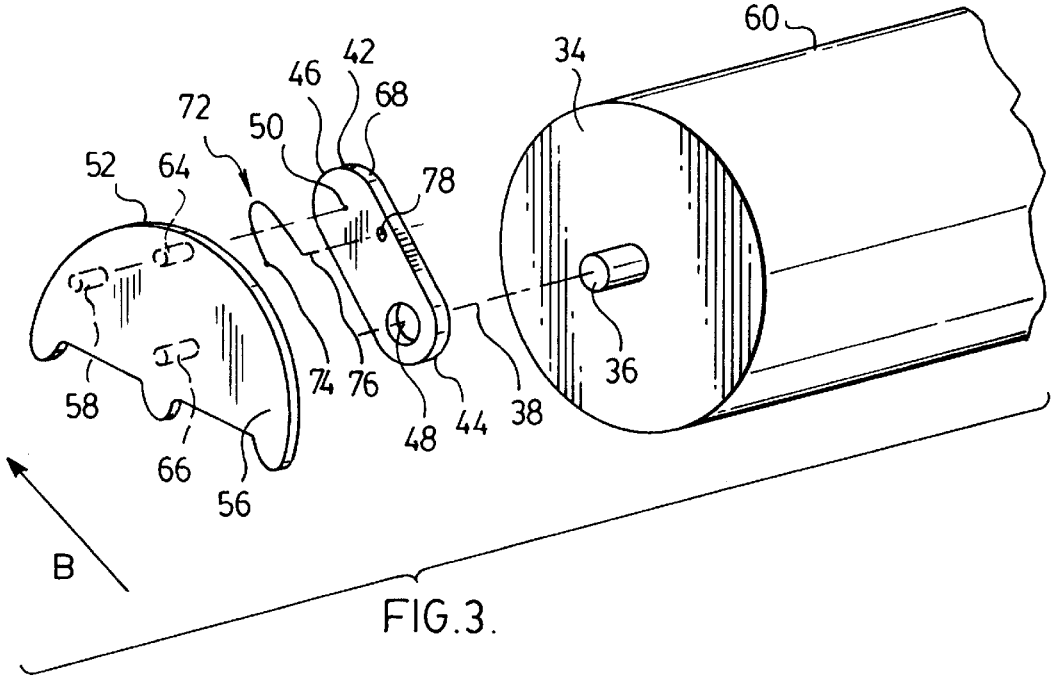
FIG. 3 is an exploded view the brush of FIG. 2.

Referring to FIG. 3, an exploded view of one of the opposed lateral ends 34 of brush 60 is provided. In FIG. 3, Arrow B is in the direction of the front end 22 of vacuum cleaner head 10. Axle 36 is provided on lateral opposed end 34. Axle 36 may extend longitudinally through brush 60 or axle 36 may comprise axle members fixed to each lateral end 34. Brush 60 has a longitudinally extending central axis 38 and axle 36 is preferably provided on axis 38 as is shown in FIG. 3.

Vacuum cleaner head 10 is provided with pivot means for pivotally mounting brush 60 to casing 20 at a position forward of central axis 38 and, preferably, at a position forward of brush 60. Any such means may be used. Preferably, the pivot means is a longitudinally extending pivot arm 42 having a first end 44 connected to brush 60 and a second end 46 pivotally mounted with respect to casing 20. Arm 42 has a first opening 48 and a second opening 50. First opening 48 is sized to rotatably receive axle 36 therein. Pivot arm 42 is pivotally connected to casing 20 by means of second opening 50. Pivot arm 42 may be pivotally mounted directly to the inner surface of sides 26. Alternately, vacuum cleaner head 10 may be provided with mounting means to which pivot arm is attached for pivotally mounting pivot arm 42 to casing 20. This later embodiment is shown in FIG. 2.

Referring to FIG. 2, each lateral side 34 of brush 60 is provided with a mounting bracket 52. Each mounting bracket 52 has an inner surface 54 and an outer surface 56. Mounting bracket 52 may be affixed to casing 20 by any means known in the art. As shown in the preferred embodiment of FIG. 2, outer surface 56 is provided with an engagement member 82 which is received in slot 84 of side surfaces 32 (see FIG. 1). Inner surface 54 is provided with a pivot mount 58. Pivot mount 58 is positioned so as to be received in second opening 50 of arm 42. Brush 60 therefore may move upwardly and downwardly as arm 42 pivots around pivot mount 58. Pivot mount 58 is positioned forward of central axis 38 and may be positioned forward of brush 60.

Figure 4:
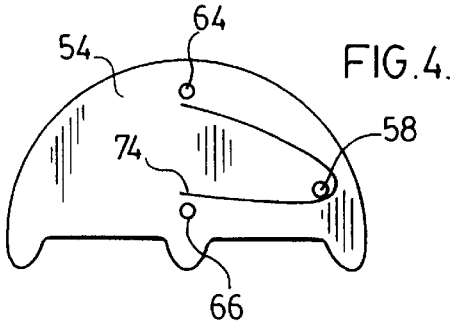
FIG. 4 is a cross section along the line 4—4 in FIG. 2.

Preferably, vacuum cleaner head is provided with stop means for limiting the upward and downward movement of the brush 60. The stop means may be provided at any position inside casing 20. Preferably, as shown in FIG. 4, inner surface 54 of mounting bracket 52 is provided with upper stop 64 and lower stop 66. The upper and lower extent of travel of arm 42 (and accordingly the raised position and the lowered position of brush 60) is defined by upper and lower stops 64 and 66 which have a longitudinally extent sufficient to interact with the upper and lower surfaces 68 and 70 of arm 42.

Brush 60 is biased to the raised position by any biasing means known in the art. The biasing means may use a compressive force or a tensile force. The biasing means preferably comprises a spring 72 which is mounted on inner surface 54 of mounting bracket 52. Spring 72 may be a generally U shaped leaf spring (see FIG. 4), eg. it may use a compressive force. Spring 72 has a first end 74 which is positioned immediately above lower stop 66. Second end 76 may extend laterally to be received in spring receiving opening 78 of arm 42. Thus, spring 72 biases arm 42 so as to abut upper stop 64. This is the raised position of arm 42 and accordingly of brush 60.

In vacuum cleaner head 10 of the instant invention, brush 60 is designed to float freely in vacuum cleaner head 10 with respect to dirty air inlet 40. Thus, as vacuum cleaner head 10 travels from one surface to another (eg. from carpet having a shorter pile to carpet having a higher pile) the increased height of the fibres will cause brush 60 to deflect upwardly to an appropriate height with respect to the carpet. Similarly, as vacuum cleaner head 10 travels from carpet having a higher pile to carpet having a shorter pile, or to a bare floor, the decreased height of the fibres will allow brush 60 to follow the top surface of the fibres downwardly to an appropriate height with respect to the carpet. Thus brush 60 may automatically adjust its height with respect to the surface on which vacuum cleaner head 10 is positioned.

Figure 5:
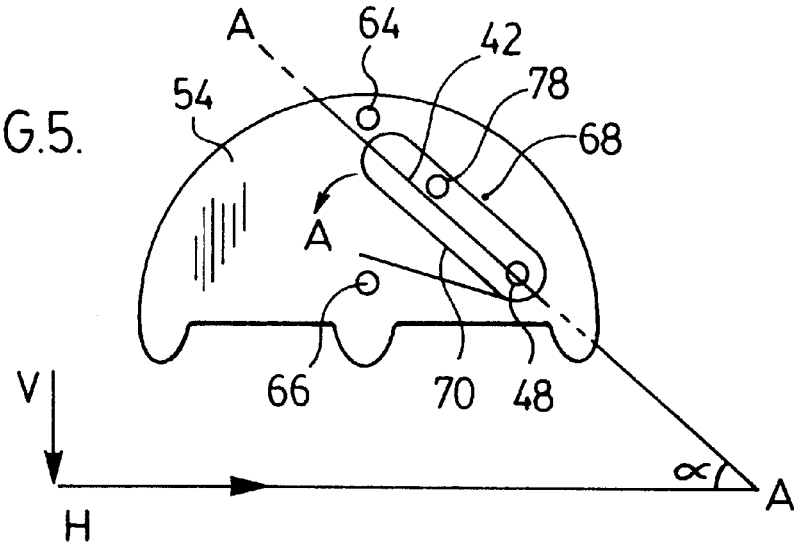
FIG. 5 is a cross section along the line 4—4 in FIG. 2 with the pivot arm also shown.
Figure 6:
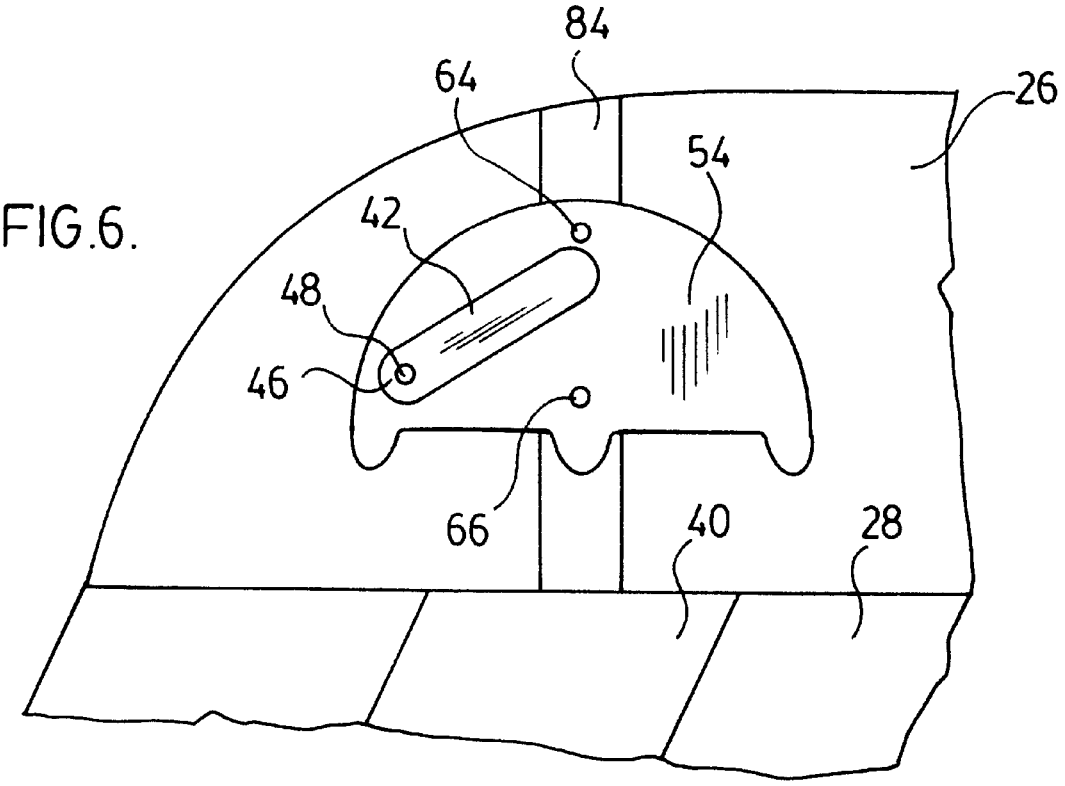
FIG. 6 is an enlargement of area A which is shown in FIG. 1.

As brush 60 rotates, it will create centrifugal force which will cause arm 42 to rotate in the direction of arrow A (see FIG. 5). The force can be resolved into two vectors, vector V which is directed downwardly and vector H which is directed forwardly (see FIG. 5). If brush 60 is mounted at a fixed position in vacuum cleaner head 10, then the centrifugal force will not cause brush 60 to move. However, with a floating brush, the downward force (vector V) will cause brush 60 to move downwardly. If brush 60 is too close to the carpet being cleaned, it will tend to dig into the carpet due to the downward component of the centrifugal force (vector V). This is particularly a problem when the vacuum cleaner head is used to clean a rug (eg. an area rug) which is not secured to the floor. The digging in can cause brush 60 to stall and may damage the carpet. In order to prevent this, vacuum cleaner head 10 is provided with biasing means to bias the brush to a raised position.

By providing pivot 58 forward of central axis 38, the forces preferably resolve so as to extend effectively along axis A—A of arm 42. Angle $\alpha$ of arm 42 with respect to the horizontal may be selected so as to be aligned with axis A—A. Accordingly, essentially all of the centrifugal force may accordingly be directed along arm 42 thereby reducing the downward force vector V exerted on brush 60. By thus reducing the downward force vector V exerted on brush 60 spring 72 need have a smaller upward biasing force thus permitting effective floating of brush 60 in vacuum cleaner head 10. Accordingly, first end 44 is disposed upwardly with respect to the second end 46 when brush 60 is in the raised position. Further, depending upon angle $\alpha$, first end 44 is preferably also disposed upwardly with respect to the second end 46 when brush 60 is in the raised position. Angle $\alpha$ may be from about 25 to about 65°, more preferably from about 35 to about 55°, more preferably from about 40 to about 50° and most preferably about 45°. The closer angle $\alpha$ is to being parallel to the direction of the resolved centrifugal force, the smaller the required upward biasing force.

Pursuant to the instant invention, the pivot means is positioned to transmit at least a portion of the force to casing 20. The pivot means is positioned to transmit at least a portion of the downward force and preferably, essentially all of the downward force to casing 10. Thus as brush 60 rotates, the downward force (vector V) may be eliminated to a sufficient degree that only a light upward force need be imposed by the biasing means upon brush 60 to permit brush 60 to float freely. In particular the pivot means is positioned to transmit a portion of the force to casing 20 such that, when brush 60 is rotating, the net downward force exerted by brush 60 (the downward force due to gravity and the centrifugal force less the upward force from the biasing means) is preferably less than 30% of the weight of the brush itself, more preferably less than 20% of the weight of the brush and most preferably about 10% of the weight of the brush. Thus, due to the substantially reduced weight of brush 60 when it is rotating, brush 60 is more responsive to the change in pile and this permits brush 60 to float freely within casing 20 when brush 60 is rotating.

While the above description constitutes the preferred embodiment, it will be appreciated that the present invention is susceptible to modification and change without departing from the fair meaning of the proper scope of the accompanying claims.

I claim:

1. A vacuum cleaner head for cleaning a surface comprising:

(a) a casing having a lower surface, a front end, a rear end and an air flow path, the air flow path including a dirty air inlet provided in the lower surface and connectable in fluid communication with a source of suction;

(b) a brush rotatably mounted above the dirty air inlet and movably mounted with respect to the dirty air inlet between a lowered position and a raised position, the brush having a longitudinally extending central axis and spaced apart opposed lateral sides;

(c) a pivot arm having a first end connected to the brush and a second end pivotally mounted with respect to the casing at a position forward of the central axis the pivot arm extends upwardly at an angle to the horizontal from the second end to the first end, the size of the angle being such that, upon rotation of the brush, a portion of the force produced by the rotation of the brush is transmitted to the casing; and, (d) a biasing member which is positioned to bias the brush to the raised position wherein upon rotation of the brush a force pivoting the brush towards the dirty air inlet is produced.

2. The vacuum cleaner head as claimed in claim 1 wherein the first end is disposed upwardly with respect to the second end when the brush is in the raised position.

3. The vacuum cleaner head as claimed in claim 1 wherein the force comprises a downward component and the size of the angle being such that at least a major portion of the downward component is transmitted to the casing.

4. The vacuum cleaner head as claimed in claim 3 wherein the angle is from 25 to 65°.

5. The vacuum cleaner head as claimed in claim 1 wherein the brush is rotatably mounted about an axle and the axle is rotatably received in the first end.

6. The vacuum cleaner head as claimed in claim 1 wherein the pivot arm comprises two pivot arms one of which is positioned adjacent each lateral side of the brush.

7. The vacuum cleaner head as claimed in claim 1 further comprising a mounting bracket provided adjacent each lateral side of the brush, each mounting bracket having an inner side facing a respective lateral end of the brush which pivotally receives thereon the second end of the respective pivot arm and an outer side to attach the mounting bracket to the casing, at least one upper stop member provided on at least one of the inner sides to engage the pivot arm when in the raised position and at least one lower stop member provided on an inner side to engage the pivot arm when in the lowered position.

8. The vacuum cleaner head as claimed in claim 7 wherein the biasing member comprises a generally U shaped leaf spring which is positioned between the mounting bracket and the brush.

9. The vacuum cleaner head as claimed in claim 8 wherein the spring has a first portion that abuts against the lower stop and a second portion that is drivenly connected to the pivot arm.

10. The vacuum cleaner head as claimed in claim 1 wherein the size of the angle is such that, when the brush is rotating, the net downward force exerted by the brush is less than 30% of the weight of the brush itself.

11. A vacuum cleaner head for cleaning a surface comprising:

(a) a casing having a lower surface, a front end, a rear end and an air flow path, the air flow path including a dirty air inlet provided in the lower surface and connectable in fluid communication with a source of suction;

(b) a brush rotatably mounted above the dirty air inlet and movably mounted with respect to the dirty air inlet between a lowered position and a raised position, wherein upon rotation of the brush a force pivoting the brush towards the dirty air inlet is produced, the brush having a longitudinally extending central axis;

(c) pivot means pivotally mounting the brush to the casing at a position forward of the central axis, the pivot means positioned to transmit at least a portion of the force to the casing the pivot means has a portion that extends rearwardly and upwardly at an angle to the horizontal, the size of the angle being such that a portion of force produced is transmitted to the casing; and, (d) biasing means to bias the brush to the raised position.

12. The vacuum cleaner head as claimed in claim 11 wherein the force comprises a downward component and the pivot means is positioned to transmit at least a major portion of the downward component to the casing.

13. The vacuum cleaner head as claimed in claim 11 wherein the force comprises a downward component and the pivot means is positioned to transmit essentially all of the downward component to the casing.

14. The vacuum cleaner head as claimed in claim 11 wherein the angle is from 25 to 65°.

15. The vacuum cleaner head as claimed in claim 11 further comprising stop means for limiting the upward and downward movement of the brush.

16. The vacuum cleaner head as claimed in claim 11 wherein the size of the angle is such that, when the brush is rotating, the net downward force exerted by the brush is less than 30% of the weight of the brush itself.

17. The vacuum cleaner head as claimed in claim 16 wherein the pivot means has a portion the extends upwardly at an angle from 35 to 55° to the horizontal.

18. A vacuum cleaner head for cleaning a surface comprising:

(a) a casing having a lower surface, a front end, a rear end and an air flow path, the air flow path including a dirty air inlet provided in the lower surface and connectable in fluid communication with a source of suction;

(b) a brush rotatably mounted above the dirty air inlet and movably mounted with respect to the dirty air inlet between a lowered position and a raised position, the brush having a longitudinally extending central axis and spaced apart opposed lateral sides;

(c) a pivot arm having a first end connected to the brush and a second end pivotally mounted with respect to the casing forward of the axis;

(d) a biasing member which is positioned to bias the brush to the raised position; and, (e) a mounting bracket provided adjacent each lateral side of the brush, each mounting bracket having an inner side facing a respective lateral end of the brush which pivotally receives thereon the second end of the respective pivot arm and an outer side to attach the mounting bracket to the casing, at least one upper stop member provided on at least one of the inner sides to engage the pivot arm when in the raised position and at least one lower stop member provided on an inner side to engage the pivot arm when in the lowered position wherein upon rotation of the brush a force pivoting the brush towards the dirty air inlet is produced.

19. The vacuum cleaner head as claimed in claim 18 wherein the biasing member comprises a generally U shaped leaf spring which is positioned between the mounting bracket and the brush.

20. The vacuum cleaner head as claimed in claim 19 wherein the spring has a first portion that abuts against the lower stop and a second portion that is drivenly connected to the pivot arm.

21. A vacuum cleaner head for cleaning a surface comprising:

(a) a casing having a lower surface, a front end, a rear end and an air flow path, the air flow path including a dirty air inlet provided in the lower surface and connectable in fluid communication with a source of suction;

(b) a brush rotatably mounted above the dirty air inlet and movably mounted with respect to the dirty air inlet between a lowered position and a raised position, wherein upon rotation of the brush a force pivoting the brush towards the dirty air inlet is produced, the brush having a longitudinally extending central axis;

(c) pivot means pivotally mounting the brush to the casing at a position forward of the central axis, the pivot means positioned to transmit at least a portion of the force to the casing;

(d) biasing means to bias the brush to the raised position; and, (e) stop means for limiting the upward and downward movement of the brush.

22. A vacuum cleaner head for cleaning a surface comprising:

(a) a casing having a lower surface, a front end, a rear end and an air flow path, the air flow path including a dirty air inlet provided in the lower surface and connectable in fluid communication with a source of suction;

(b) a brush rotatably mounted above the dirty air inlet and movably mounted with respect to the dirty air inlet between a lowered position and a raised position, the brush having a longitudinally extending central axis and spaced apart opposed lateral sides;

(c) a pivot arm having a first end connected to the brush and a second end pivotally mounted to the casing the pivot arm is positioned such that, upon rotation of the brush, a major portion of the force produced by the rotation of the brush is transmitted to the casing; and, (d) a sole biasing member which is positioned to bias the brush to the raised position wherein any movement of the brush to the lowered position is caused solely by rotation of the brush.

* * * * *